United States Patent [19]

Otterson

[11] 4,253,587

[45] Mar. 3, 1981

[54] RECLOSABLE CLOSURE FOR POWDER CAN

[75] Inventor: Lewis L. Otterson, Chagrin Falls, Ohio

[73] Assignee: Weatherchem Corporation, Twinsburg, Ohio

[21] Appl. No.: 51,378

[22] Filed: Jun. 25, 1979

[51] Int. Cl.[3] ..... B65D 41/16

[52] U.S. Cl. ..... 222/151; 222/485; 222/556

[58] Field of Search ..... 222/142.1, 151, 485, 222/556, 563, 565, 480

[56] References Cited

U.S. PATENT DOCUMENTS

| | | | |
|---|---|---|---|
| 2,710,122 | 6/1955 | Friedman | 222/563 |
| 2,781,146 | 2/1957 | Eddy . | |
| 2,849,164 | 8/1958 | Weisgerber | 222/563 X |
| 3,217,949 | 11/1965 | Davis . | |
| 3,262,606 | 7/1966 | Waterman . | |
| 3,675,812 | 7/1972 | Foster | 222/565 X |
| 4,029,033 | 6/1977 | Kerwin et al. | 222/563 X |
| 4,106,672 | 8/1978 | Tecco et al. . | |

*Primary Examiner*—David A. Scherbel

*Attorney, Agent, or Firm*—Pearne, Gordon, Sessions, McCoy & Granger

[57] ABSTRACT

A closure for the usual circular array of holes provided in the top wall of a can of cleaner or the like for dispensing the contents of the can. The closure includes a disc overlying the circular array of holes but covering only a minority of the area of the top wall. The disc is divided into a lid portion and a base portion. Protrusions on the underside of the base portion are relatively fixedly retained in their corresponding holes. Protrusions on the underside of the lid portion are relatively releasably retained in their corresponding holes.

2 Claims, 6 Drawing Figures

FIG. 1
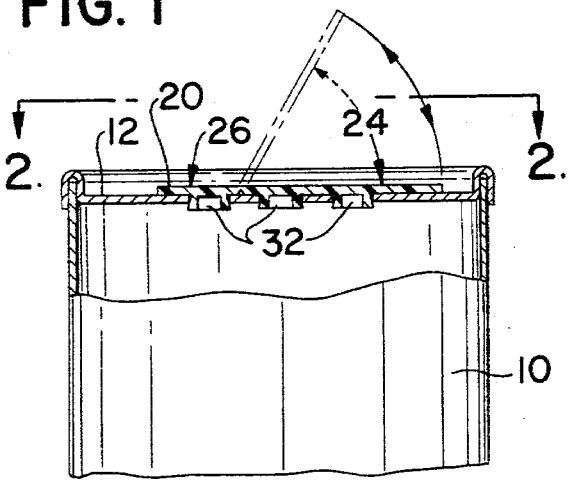
FIG. 2
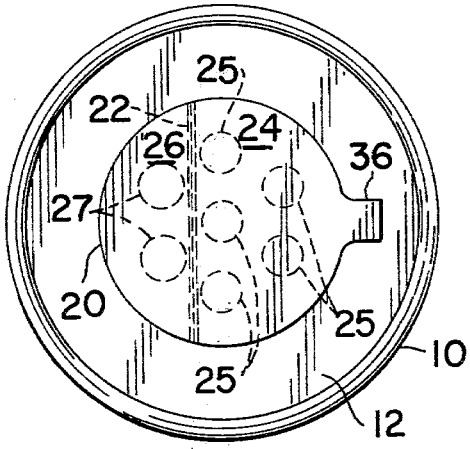
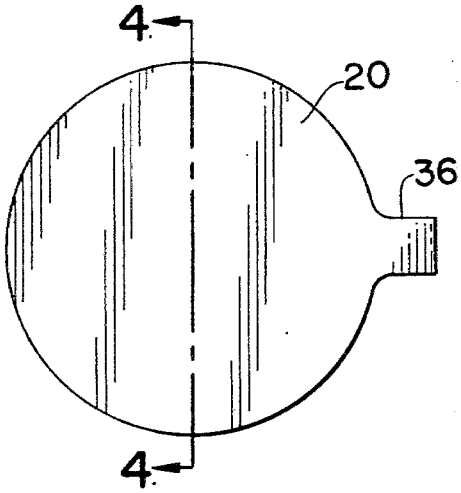
FIG. 3
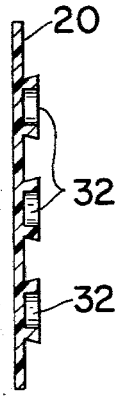
FIG. 4
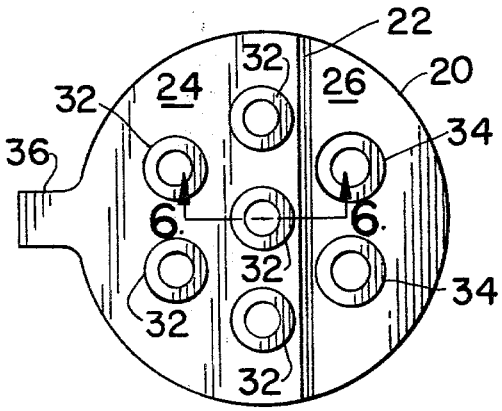
FIG. 5
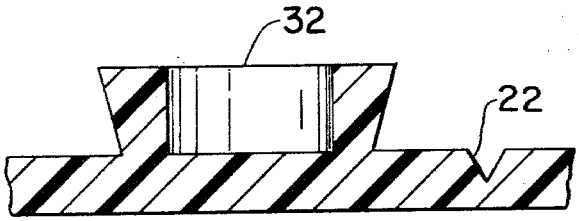
FIG. 6

RECLOSABLE CLOSURE FOR POWDER CAN

BACKGROUND OF THE INVENTION

This invention relates to closures for dispensing cans of the kind used in packaging powdered cleaners and the like.

Such containers are usually made with metal top and bottom ends and with paperboard sidewalls. A circular array of holes is conventionally formed at the central region of the top wall for dispensing the powdered product contained in the can.

So that these holes may be closed during shipment and storage, they are sometimes provided as only partly punched-out openings, and the end user then must complete the punching. Once the holes are opened, they cannot be reclosed.

In order to spare the end user the inconvenience of completing the punching, some cans are provided with completely punched-out holes and the array of holes is covered by adhesive tape which can readily be removed by the end user. With such an arrangement, the holes cannot be conveniently and reliably reclosed with the tape because of the inconvenience of keeping track of the tape for reuse and because of the tendency of the powder being dispensed to degrade or destroy the adhesion of the tape.

Relatively rigid plastic lids with projecting closures for the array of holes have been provided, but, again, their use involves keeping track of a removed element—the lid—for reuse. There are also relatively high material costs associated with providing a plastic closure lid over the end wall. Weisgerber U.S. Pat. No. 2,849,164 shows such a closure.

The present invention overcomes the disadvantages of the prior art in respect of arrangements for reclosing the array of holes. According to the invention, the only portion of the top wall covered by additional plastic closure material is the region immediately over the circular array of holes, thus greatly reducing material costs of the reclosable closure by covering only a minority of the area of the top wall of the container. Further according to the invention, a minor number of the holes in the circular array are utilized for permanent anchoring of the closure means, and the closure means is hinged to provide a lid portion that closes and reopens the remaining holes in the circular array.

The result is a closure which fills the need which has long been felt for an economic, conveniently usable, reclosable closure for the circular array of holes provided in cans of cleaner and the like.

The invention will be more fully understood from the following description of a specific embodiment thereof.

In the accompanying drawings,

FIG. 1 is a side elevation, partly broken away, of the top portion of a cleanser can which uses the invention.

FIG. 2 is a view taken on the plane of line 2—2 in FIG. 1.

FIG. 3 is a top view, on a slightly larger scale, of the closure of the invention.

FIG. 4 is a cross-section taken on the plane of line 4—4 in FIG. 3.

FIG. 5 is a bottom view of the same closure.

FIG. 6 is a fragmentary cross-section, on a larger scale, taken on the plane of line 6—6 in FIG. 5.

A cylindrical container 10 for powdered products or the like, such as kitchen cleanser, is provided with a top wall 12 in which a circular array of holes is provided in a conventional manner. The circular array of holes is seen in dotted line in FIG. 2, and is used for dispensing the powdered product contained in the can.

According to the present invention, coverage for the circular array of holes is provided by a plastic disc 20 which overlies only a minority of the total area of the top wall 12. The disc 20 is generally concentric with the circular array of holes, and is hinged along a cord line, as by a groove 22. As can be seen in FIG. 2, the groove or cord line 22 does not overlie any portion of any of the holes of the circular array but, rather, divides the disc 20 into a lid area 24 and a base area 26, each of which overlies the entireties of all holes of an associated sub-array. Thus, in the illustrated example, the lid area 24 covers the entireties of the holes 25 and the base area 26 covers the entireties of the holes 27.

A circular array of protrusions (FIG. 5) on the underside of the disc 20 matches the circular array of holes in one-to-one correspondence. The circular array of protrusions includes a first sub-array of protrusions 32 on the underside of the lid area 24 and corresponding to the first sub-array of holes 25. A second sub-array of protrusions 34 corresponds to the second sub-array of holes 27.

The protrusions 32 and 34 are received and retained in the holes 25 and 27, respectively. The protrusions 32 are preferably more readily releasable from the holes 25 than are the protrusions 34 from the holes 27, so that the protrusions 34 are relatively fixedly retained in the holes 27. This may be accomplished simply by dimensioning the protrusions 34 somewhat larger than the protrusions 32, as shown in FIG. 5.

The protrusions may be slightly flared annuli that depend from the wall of the lid 12, as illustrated in the drawings, or they may be any other suitable shape. The lid 20 may be provided with a lift tab 36.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a reclosable closure for the circular array of holes which is provided in the top wall of cleanser cans and the like for dispensing the powdered product contained in the can, a plastic disc overlying all said holes of said array but overlying only a minority of the total area of said top wall, said disc being generally concentric with said array and being hinged along a chord line and being relatively rigid at other locations, said chord line overlying no portion of any of said holes of said array but rather dividing said disc into (1) a lid area overlying the entireties of the members of a first sub-array of said holes comprising a majority of the members of said circular array of holes and (2) a base area overlying the entireties of the members of a second sub-array of said holes comprising the remaining minority of the members of said circular array of holes, a circular array of protrusions on the underside of the plastic disc matching said circular array of holes and respectively receivable in the members of said circular array of holes in one-to-one correspondence, said circular array of protrusions comprising (1) a first sub-array of said protrusions on the underside of said lid area and corresponding to said first sub-array of holes and (2) a second sub-array of said protrusions on the underside of said base area and corresponding to said second sub-array of holes, said disc being reclosably held on said top wall exclusively by said protrusions being received and retained in said holes, the circular array of holes and protrusions having a regular angular spacing, the disc protrusions being registrable for assembly with the top wall holes in any one of a number of angular positions equal to the number of holes in the periphery of the circular array.

2. A closure as in the preceding claim, the members of said first sub-array of protrusions being relatively easily releasably retained in said first sub-array of holes, the members of said second sub-array of protrusions being relatively fixedly retained in said second sub-array of holes.

* * * * *